US007866950B1

(12) United States Patent
Wilson, Jr.

(10) Patent No.: US 7,866,950 B1
(45) Date of Patent: Jan. 11, 2011

(54) TURBINE BLADE WITH SPAR AND SHELL

(75) Inventor: Jack W Wilson, Jr., Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 82 days.

(21) Appl. No.: 12/176,622

(22) Filed: Jul. 21, 2008

Related U.S. Application Data

(60) Provisional application No. 61/008,992, filed on Dec. 21, 2007.

(51) Int. Cl.
*F01D 5/30* (2006.01)

(52) U.S. Cl. ..... 416/225; 416/193 A; 416/226; 416/233

(58) Field of Classification Search ..... 416/92, 416/96 A, 193 A, 223 A, 223 R, 224, 225, 416/226, 228, 232, 233, 248
See application file for complete search history.

(56) References Cited

U.S. PATENT DOCUMENTS 3,073,569 A * 1/1963 Wagner ..... 416/204 R
4,473,336 A * 9/1984 Coney et al. ..... 416/96 R
4,650,399 A * 3/1987 Craig et al. ..... 416/97 R
4,859,149 A * 8/1989 McClain ..... 416/215
5,277,548 A * 1/1994 Klein et al. ..... 416/193 A
6,234,753 B1 * 5/2001 Lee ..... 416/97 R
7,080,971 B2 * 7/2006 Wilson et al. ..... 416/92
7,736,131 B1 * 6/2010 Wilson, Jr. ..... 416/226

* cited by examiner

*Primary Examiner*—Edward Look
*Assistant Examiner*—Ryan H Ellis
(74) *Attorney, Agent, or Firm*—John Ryznic

(57) ABSTRACT

A turbine blade for use in a gas turbine engine, where the turbine blade is made from a spar and shell construction in which a thin walled shell is held in place between the blade tip and the platform by only a mechanical fastener without using any bonding, welding or brazing. The spar is connected to an attachment by a tie bolt, and a separate platform is secured, over the attachment t in which the shell is held against. This provides for a thermally free platform and shell connection. With this arrangement, the shell is held under compression within the 2% yield stress range such that the turbine blade shell can have an infinite life. Also, the turbine blade is much lighter than prior art blades. As a result, the spar and shell blade produces less stress on the rotor disk during engine operation.

20 Claims, 6 Drawing Sheets

View A-A

TURBINE BLADE WITH SPAR AND SHELL

CROSS-REFERENCE TO RELATED APPLICATIONS

This application claims the benefit to U.S. Provisional Patent Application 61/008,992 filed on Dec. 21, 2007 and entitled TURBINE BLADE WITH SPAR AND SHELL.

FEDERAL RESEARCH STATEMENT

None.

BACKGROUND OF THE INVENTION

1. Field of the Invention

The present invention relates generally to a gas turbine engine, and more specifically to a turbine blade formed from a spar and shell.

2. Description of the Related Art Including Information Disclosed Under 37 CFR 1.97 and 1.98

In a gas turbine engine, a compressed air from a compressor is burned with a fuel in a combustor to produce a hot gas flow. The hot gas flow is passed through a multiple stage turbine to convert most of the energy from the gal flow into mechanical work to drive the compressor, and in the case of an aero engine to drive a fan, and in the case of an industrial gas turbine (IGT) engine to drive an electric generator to produce electrical power.

The efficiency of the engine can be increased by passing a higher temperature gas into the turbine, or a higher turbine inlet temperature. However, the maximum turbine inlet temperature will depend upon the material properties of the first stage turbine stator vanes and rotor blades, since these airfoils are exposed to the highest gas flow temperature. Modern engine has a turbine inlet temperature around 2,400 degrees F., which is much higher than the melting point of a typical modern vane or blade. These airfoils can be used under these high temperature conditions due to airfoil cooling using a mixture of convection cooling along with impingement cooling and film cooling of the internal and the external surfaces of these airfoils.

A few very high temperature materials exist that have melting points well above modern engine turbine inlet temperatures. Columbian has a melt temperature of up to 4,440 F; TZM Moly up to 4,750 F; hot pressed silicon nitride up to 3,500 F; Tantalum up to 5,400 F; and Tungsten up to 6,150 F. these materials would allow for higher turbine inlet temperatures. However, these materials cannot be cast or machined to form turbine airfoils.

On prior art method of forming a turbine airfoil from one of these exotic high temperature materials is disclosed in U.S. Pat. No. 7,080,971 B2 issued to Wilson et al on Jul. 25, 2006 and entitled COOLED TURBINE SPAR SHELL BLADE CONSTRUCTION, the entire disclosure being incorporated herein by reference. The shell is formed from a wire EDM process to form a thin walled airfoil shell, and the shell is held in compression between a spar tip and the blade platform or root section. The shell can take the higher gas flow temperatures, and the spar provide internal cooling for the airfoil walls.

BRIEF SUMMARY OF THE INVENTION

It is an object of the present invention to provide for a turbine airfoil with a very long life prediction for the shell.

It is another object of the present invention to provide for a shell formed from a wire EDM process.

It is another object of the present invention to provide for a spar and shell turbine blade in which the shell is supported in compression to increase the life and allow for CMC, micro porous TBC coating, and silicon nitride.

It is another object of the present invention to provide for a spar and shell turbine blade with a thermally free platform to relieve thermal fight.

It is another object of the present invention to provide for a spar and shell turbine blade which eliminates bonds, welds and brazes.

It is another object of the present invention to provide for a spar and shell turbine blade with a much lighter weight.

A turbine blade made from a spar and shell construction in which the spar is connected to the attachment section of the blade by only a mechanical fastener without bonds, welds or brazing. The shell is held in place between the blade tip connected to the spar and the platform of the blade. The platform is a separate piece from the attachment portion in order to provide for a thermally free platform to relieve the thermal fight between the platform and the airfoil portion. The shell can be held in compression so that an infinite life for the blade can be obtained. A tie bolt is used to fasten the spar to the attachment, and the attachment includes a cavity and an opening on the bottom in which a hex nut and be inserted onto the tie bolt and a tool inserted to tighten the tie bolt and secure the shell between the blade tip and the platform.

DETAILED DESCRIPTION OF THE INVENTION

Figure 1:
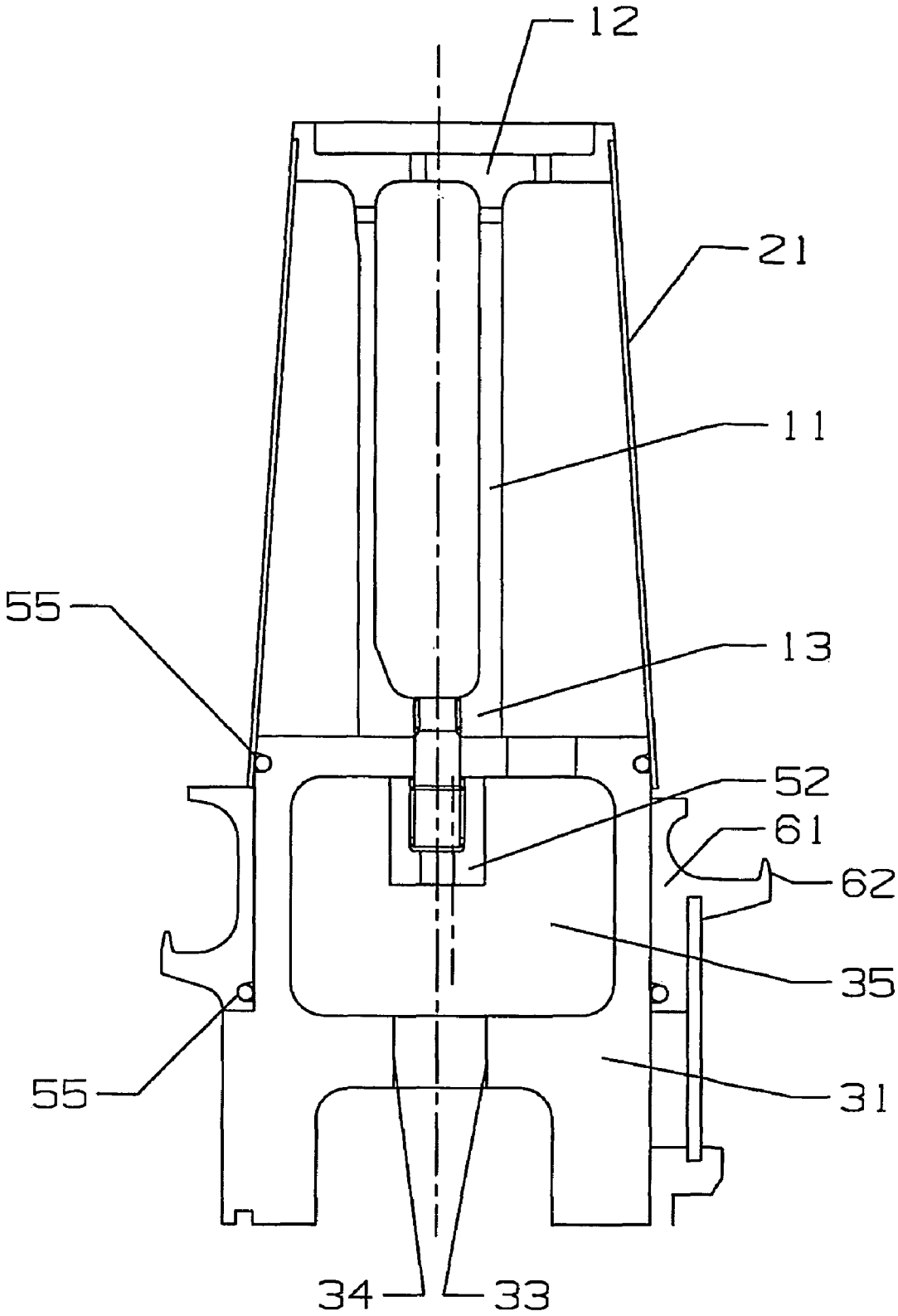
FIG. 1 is a pressure side view of a cross section of the turbine blade of the present invention.

The present invention is a turbine blade with a spar and shell construction that reduces or eliminates the problems discussed above in the background. The blade 10 is shown in FIG. 1 and includes a spar 11 with a tip end 12 and a platform end 13, a shell 21 made from high temperature resistant material such as Moly (Molybdenum) or CM247, or Tungsten, and an attachment 31 section in which the spar 11 and the shell 21 are secured against. The attachment 31 can be a single piece or made from several pieces secured together to form the root of the blade with a rotor disk attachment such as a fir tree configuration, and a platform to form a seal with adjacent airfoils in the turbine. A platform section 61 with fingers 62 that form part of a labyrinth seal is mounted onto the attachment 31 and forms the platform for the blade. In the FIG. 1 embodiment, the tip 12 and the spar 11 are a single piece. However, in another embodiment the tip that forms the blade tip and holds the shell in place can be formed as a separate piece from the spar and secured to the spar by any well known means such as bonding or a mechanical fastener. In another embodiment, the attachment 31 and the platform 61 can be formed as a single piece instead of separate pieces as shown in FIG. 1.

The shell 21 is made from a material that cannot be cast or machined using prior art forming processes, and is made from a very high temperature resistant material that can be formed from a process such as a straight line wire EDM process. The shell 21 is a thin walled surface that forms the airfoil portion of the blade and includes the leading edge and the trailing edge, and the pressure side and the suction side walls. The shell 21 thickness about 0.060 inches. The shell 21 is held in compression during engine operation between the spar tip 12 and the platform 61. If the shell 21 is made from molybdenum, it is predicted that the thermal stress parameter will be improved by more than four times over the prior art single crystal turbine blade (PWA-1483). The use of Columbium for the shell will improve the thermal stress parameter three times. The shell can also be made from PWA single crystal material.

Figure 2:
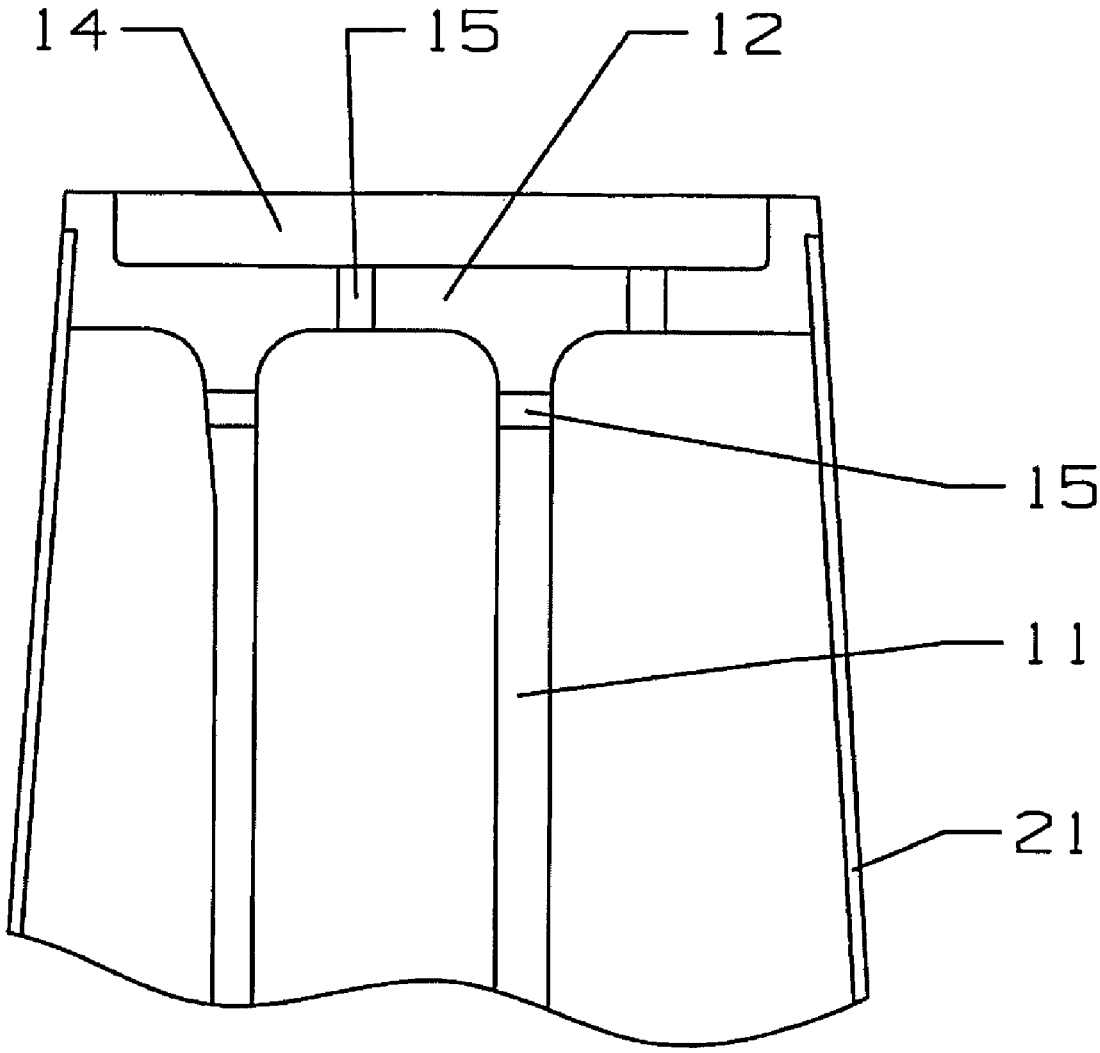
FIG. 2 is a detailed view of the tip of the blade in FIG. 1.

The spar 11 includes a tip section 12 as seen in more detail in FIG. 2. The tip 12 includes a squealer tip 14 formed by the tip walls around the airfoil surfaces, cooling holes 15 on the tip and the side of the spar 11 to provide cooling for the squealer tip and the backside surface of the shell 21. The outside edges of the tip 12 also include a recessed groove with an abutment portion in which the top end of the shell 11 is secured to the spar tip 12. The lower end of the spar 13 includes a threaded hole about in the center in which a tie bolt screws into in order to pull the spar 11 against the upper surface of the platform 31 and secure the shell 21 in-between the spar tip 12 and the platform 31. The spar and the platform can be cast or machined, and can be made from different materials. The shell is to be secured between the spar tip and the platform in which the shell stress is below the elastic 0.2% yield stress in order to provide an infinite LCF life as predicted. The spar is placed in tension when the shell is compressed between the spar tip and the platform.

Figure 3:
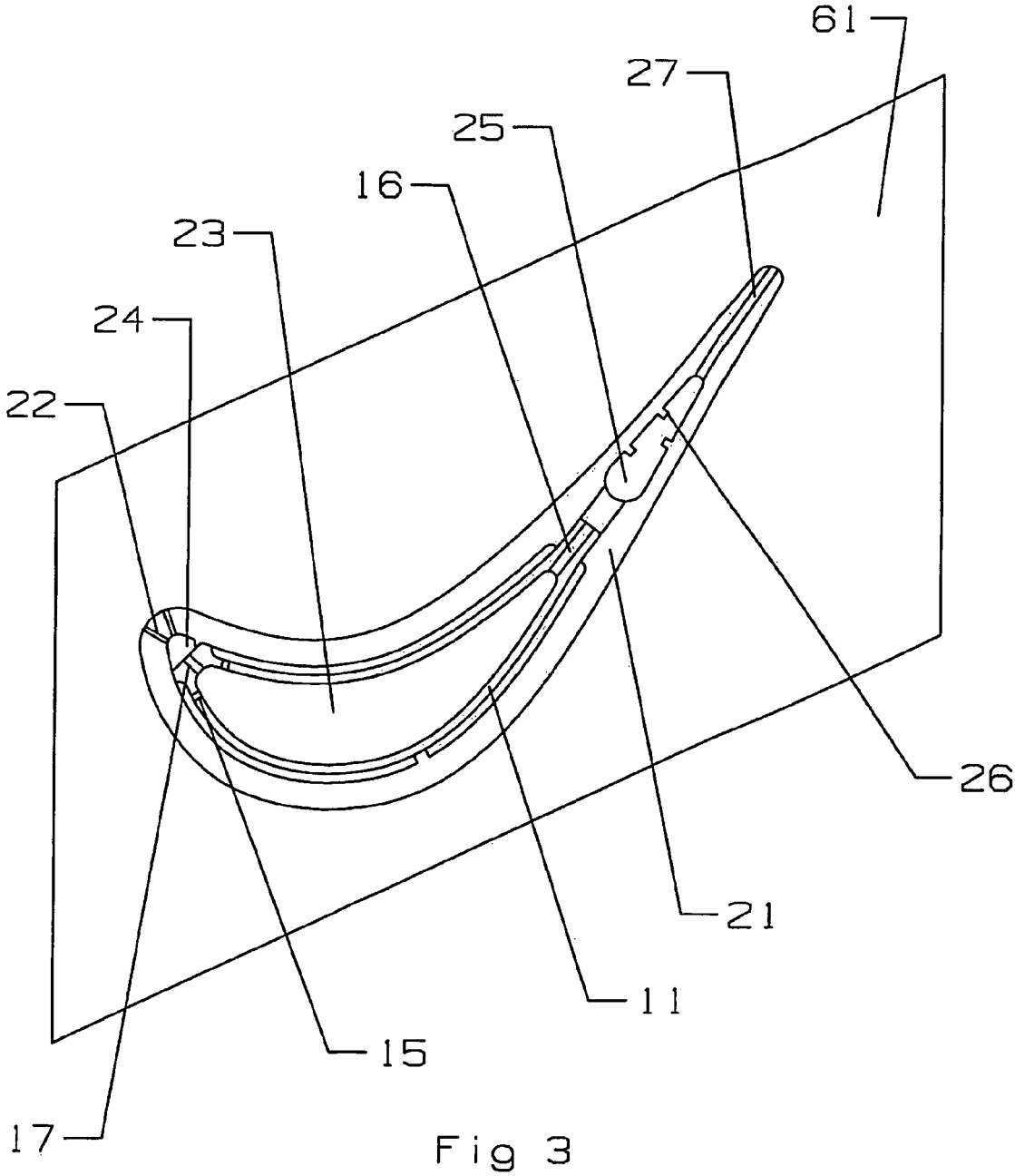
FIG. 3 shows a top view of a cross section of the spar and shell and the platform of the blade of FIG. 1.

FIG. 3 shows a top view of a cross, section through the blade which shows the platform outer surface and the cooling passages formed within the spar and the shell assembly. The platform 31 is standard in shape. The spar 11 includes a leading edge, with a row of metering and impingement holes 17 and two rows of impingement holes 15 one on the pressure side and the second on the suction side. The spar 11 forms a cooling air supply cavity 23 and has a row of exit cooling holes 16 on the trailing edge side of the spar 11. The shell 21 includes a leading edge with a showerhead arrangement of film holes 22. A leading edge impingement cavity 24 is formed between the spar and the shell. The trailing edge region of the shell includes a trailing edge cavity 25 with a plurality of trip strips 26 spaced along the side walls in an alternating arrangement to act as turbulent promoters for the cooling air. A row of trailing edge exit holes 27 is formed along the trailing edge of the shell 21. The spar and shell form a pressure side impingement cavity and a suction side impingement cavity between the metering hole 17 and the exit hole 16. Impingement holes 15 formed on the spar 11 force pressurized cooling air from the cavity 23 to impinge against the inner side walls of the shell to provide impingement cooling. Cooling air from the cavity 23 also flows through the exit holes 16, then through the trailing edge cavity 25 and out the exit holes 27 to provide cooling for the trailing edge region.

Ribs can also be used to prevent bulging of the airfoil wall. The ribs can formed on the inner surface of the shell and extend inward to abut the spar, or the ribs can be formed on the spar and extend outward and abut against the shell. In one embodiment, one rib formed on the shell extends inward and abuts against the spar at about a midpoint within the suction side impingement cavity as seen in FIG. 3. One or more ribs can be included on the pressure side of the airfoil to provide support for the shell 21 against the spar 11.

Figure 6:
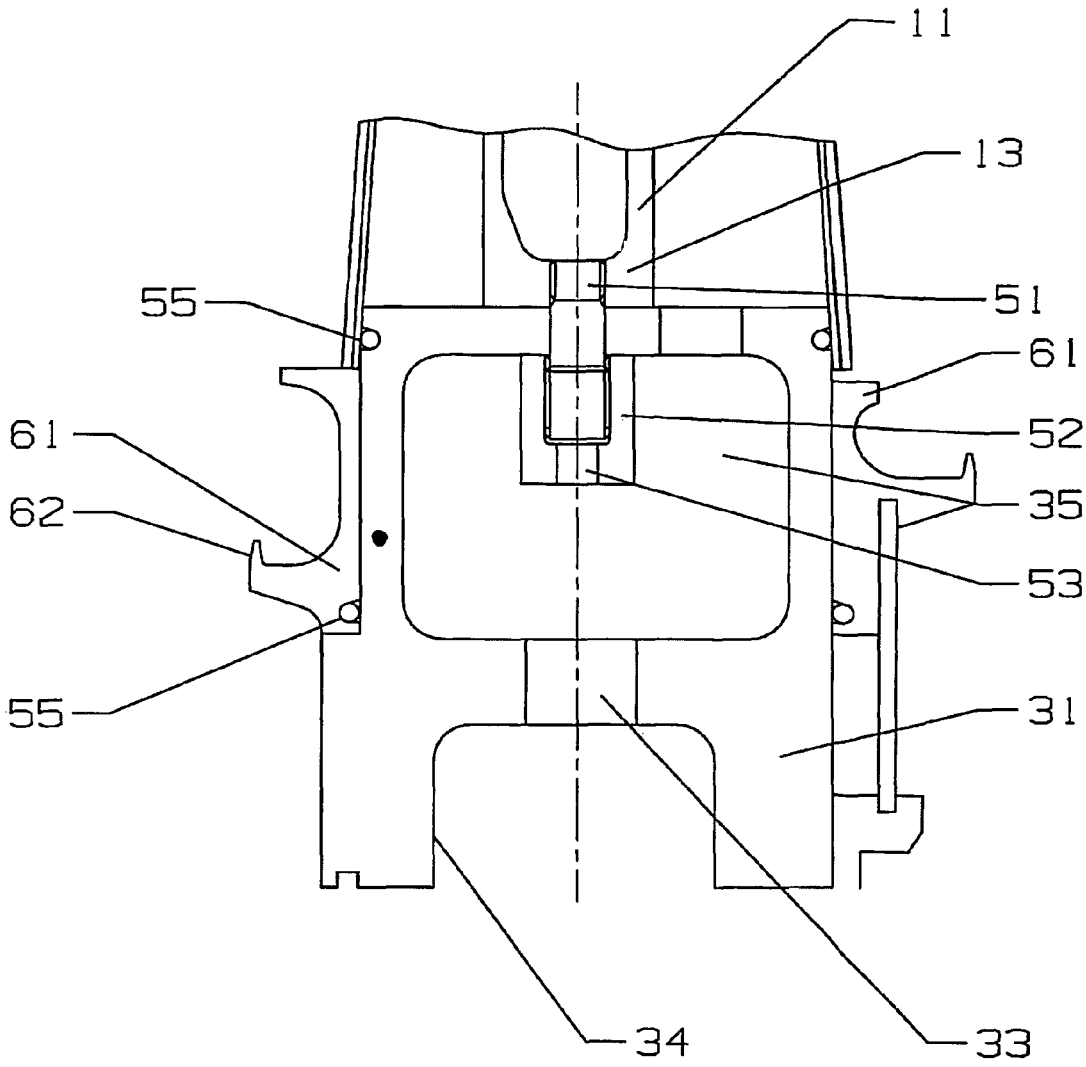
FIG. 6 shows a detailed side view of the spar to root attachment connection of the blade of FIG. 1.
Figure 7:
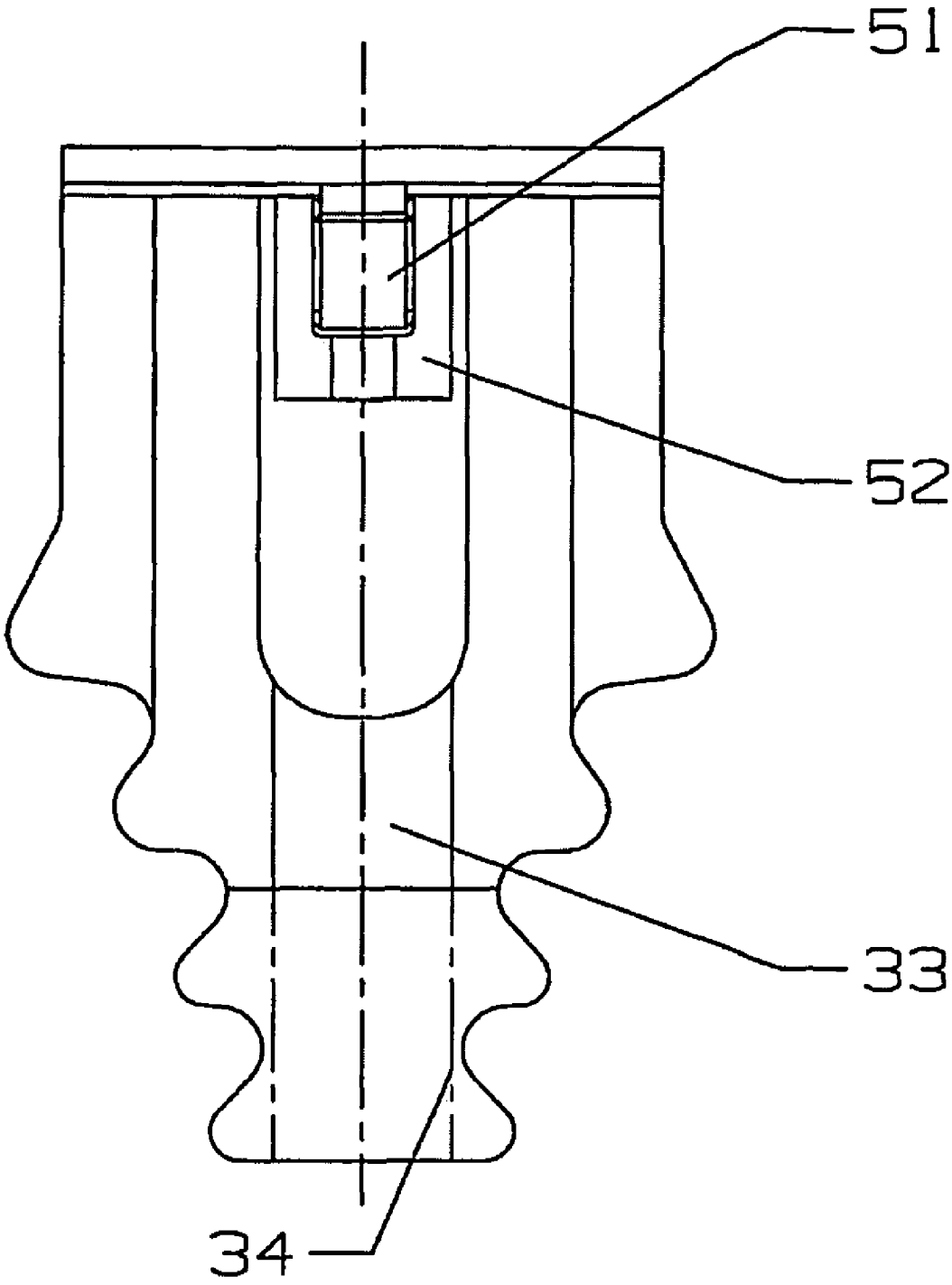
FIG. 7 shows a detailed front view of the lower part of the attachment connection of FIG. 6.

FIG. 6 shows a detailed view of the tie bolt and spar to attachment connection. The spar 11 includes a threaded hole on the bottom end 13 in which the tie bolt 51 screws into. The attachment 31 includes an inner cavity 35 and a top surface with a hole for insertion of the tie bolt 51. The lower end of the tie bolt 51 also includes threads on the outer surface in which an Allen nut 52 screws onto. The Allen nut 52 includes a hex shaped opening on the bottom in which a wrench or other tool is inserted into and screw the Allen nut onto the threaded bottom portion of the tie bolt 51. The attachment 31 includes a slot 34 on the bottom and an opening 33 on the top surface of the slot 34 for insertion of the Allen nut and the wrench to remove or secure the Allen nut 52 to the tie bolt 51. FIG. 7 shows a front view of the tie bolt and spar and shell interface when assembled. The tie bolt 51 is made from MP159 for resistance to the high temperature environment of the platform and the attachment, has a diameter of 0.750 inches, and includes 16 threads. However, other diameters and thread numbers are possible in order to retain the spar 11 to the attachment 31. The tie bolt 51 must be capable of withstanding very high stress levels in order to secure the shell 11 between the spar tip and the platform 61 during engine operation. One or more tie bolts 51 can be used to secure the spar to the shell.

Figure 4:
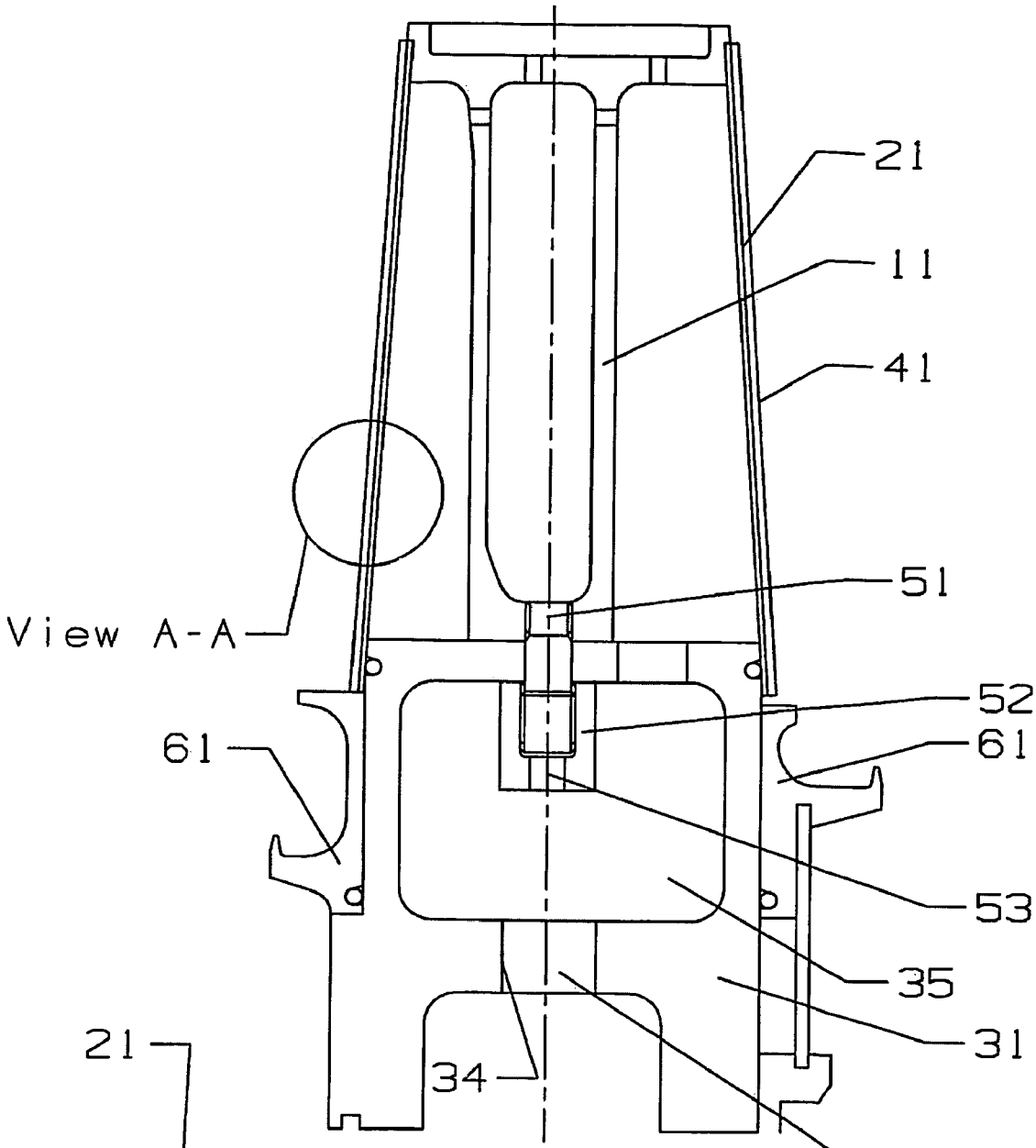
FIG. 4 shows a side view of a cross section of a second embodiment of the turbine blade of the present invention.

The shell 21 is secured to the spar 11 and attachment 31 in a thermally free manner by allowing for a space to exist between the bottom of the shell 21 and the top surface of the attachment 31. As seen in FIG. 1, an upper wire seal 55 is held within an outer groove formed in the attachment 31 with a slanted upper surface. The wire seal 55 is forced upward from the centrifugal force developed during rotation of the blade. This forces the wire seal 55 up against the shell 21 surface and the upper groove surface to form a tight fitting seal. Rotation of the blade will also force the shell 21 upward against the spar tip groove and abutment surface. Thermal expansion of the shell 21 will force the lower end of the shell 21 downward but without making contact with the attachment 31 so that the shell 21 remains detached from the attachment 31. A second wire seal 55 is placed within an inward facing groove formed on the platform 61 on the lower end as seen in FIGS. 1 and 4. The top of the groove is also slanted upward so that the wire seal is forced upward and against the outer surface of the attachment to produce a tight fitting seal under rotation of the blade.

Because the shell 21 is held under compression during engine operation, an infinite life for the shell is predicted. A life of from 5 to 25 times longer than the prior art blades is predicted. Thus, the turbine blade with the spar and shell construction of the present invention can be used in an engine, such as an industrial gas turbine engine, for long periods without repair or replacement. Also, because the shell is held in compression (instead of tension in the solid blades of the prior art), the blade with a TBC applied will not spall (TBC chips off from the surface) as much and therefore will have a longer service life as well. The increased life of the blade will allow for CMC, a micro porous TBC to be applied over the shell, and silicon nitride. The blade also eliminates the need for bonds, welds and brazes so that only a mechanical attachment is needed.

Another benefit from the turbine blade with the spar and shell constriction of the present invention is the weight savings over the prior art blade. A large IGT engine used for power production includes 72 blades in the first stage of the turbine, and each blade weighs 14.7 pounds including the TBC. The blade of the present invention weighs 10.9 pounds which is almost 4 pounds less than the prior art. A lighter blade will produce a lower stresses on the rotor disk due to the lower centrifugal forces developed than in the prior art blade.

Lower stress on the rotor disk will allow for smaller and lower weight rotor disks, or improved disk LCF life at the life limiting location.

The process for assembling the turbine blade is described next. The spar 11 is secured to the shell 21 at the tip 12. A lower wire seal is placed within the groove of the platform 61 using wax to hold the wire seal in place. The platform 61 is then assembled over the fir tree attachment 31 with an upper wire seal waxed into place within the groove formed in the attachment 31. The tie bolt 51 is then installed into the spar 11 using a left hand thread. The attachment 31 and the platform 61 are then installed into the spar and shell. A torque nut is then screwed onto the tie bolt to tighten the assembly.

Figure 5:
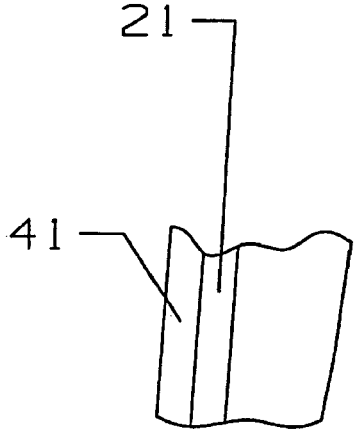
FIG. 5 shows a detailed view of the shell and TBC surface of the circle from FIG. 4.

FIG. 4 shows an additional embodiment of the present invention in which a TBC is applied over the shell to add thermal protection. The TBC has a thickness of around 0.020 inches. FIG. 5 shows a detailed view of the shell 21 with the TBC 41 applied over the outer surface. In still another embodiment, the shell is made from porous Molybdenum with a thickness of around 0.120 inches. The porous Moly is made from a process by Mikro Systems, Inc., of Charlottesville, Va., with a porosity of around 50% but can be less or more depending on the structural strength of the shell and the cooling air flow through the pours. The process is capable of making the shell from any of these high temperature resistant materials that cannot be made from casting or machining. A TBC is applied over the porous shell. When a piece of the TBC spalls off, cooling air will flow through the exposed porous surface to cool the part of the shell and prevent ingestion of hot gas. The porous shell will also hold the TBC to the shell surface better than would a flat surface.

Another feature of the spar and shell turbine blade of the present invention is the reduction in the casting technology used to form the blade. A lower level of casting technology allows for alternative casting vendors to be used to manufacture the blade. The present invention provides approximately 30% reduction is size of casting footprint. Casting costs are a function of parts per mold and casting yield. Removing the platform would allow more parts per mold for airfoil spar and increased yield. Separate platform would permit (if cast) cored platforms and other high technology features to be used.

I claim the following:

1. A turbine blade for use in a gas turbine engine, the turbine blade comprising:

an attachment;

a spar and a blade tip;

a shell having an airfoil cross sectional shape with a leading and a trailing edge, and a pressure side and a suction side extending between the leading and trailing edges;

a platform extending outward from the attachment;

the shell being held in place between the blade tip and the platform;

the spar and the attachment being a separate piece; and, a vertical axis tie bolt and an Allen nut to secure the attachment to the spar.

2. The turbine blade of claim 1, and further comprising:

the attachment includes an inner enclosed cavity and an opening on a bottom side for insertion of the Allen nut and a tool to tighten the Allen nut onto the tie bolt.

3. The turbine blade of claim 1, and further comprising:

the platform and the attachment are separate pieces.

4. The turbine blade of claim 3, and further comprising:

the platform is mounted to the attachment to form a thermally free platform to relieve thermal fight.

5. The turbine blade of claim 1, and further comprising:

the spar and the blade tip are formed as a single piece.

6. The turbine blade of claim 1, and further comprising:

the spar includes impingement cooling holes along the length of the spar to direct impingement cooling air against the inner surface of the shell wall.

7. The turbine blade of claim 1, and further comprising:

the blade tip includes a groove along the outer edge to slidingly secure the shell to the blade tip in the spanwise direction of the blade.

8. The turbine blade of claim 1, and further comprising:

the blade tip forms a squealer tip pocket.

9. The turbine blade of claim 8, and further comprising:

the blade tip includes cooling holes to discharge cooling air into the squealer tip pocket.

10. The turbine blade of claim 1, and further comprising:

the tie bolt includes threads on the upper end of the tie bolt to screw into a threaded hole formed in the lower end of the spar, and the tie bolt including threads on the lower end to screw into a threaded hole in an Allen nut.

11. The turbine blade of claim 1, and further comprising:

the spar has an airfoil cross sectional shape such that a space between the shell inner wall and the spar outer wall is substantially the same on the pressure side and the suction side of the blade.

12. The turbine blade of claim 1, and further comprising:

the shell is a thin walled surface.

13. The turbine blade of claim 12, and further comprising:

the shell is made from one of Molybdenum, chromium or a single crystal material.

14. The turbine blade of claim 12, and further comprising:

the shell thickness is around 0.060 inches.

15. The turbine blade of claim 12, and further comprising:

the shell is secured in compression between the blade tip and the platform such that the shell stress is less than the elastic 0.2% yield stress in order to provide an infinite LCF life for the shell.

16. The turbine blade of claim 12, and further comprising:

the shell is secured between the blade tip and the platform without a bond, a weld or a braze, and only with a mechanical attachment.

17. The turbine blade of claim 1, and further comprising:

the tie bolt is made from a high temperature resistant material.

18. The turbine blade of claim 17, and further comprising:

the tie bolt is made from MP159.

19. A turbine blade for use in a gas turbine engine, the turbine blade comprising:

an attachment including means to secure the turbine blade to a slot formed in a rotor disk of the turbine;

a spar and a blade tip;

a shell having an airfoil cross sectional shape with a leading and a trailing edge, and a pressure side and a suction side extending between the leading and trailing edges;

a platform extending outward from the attachment;

the shell being held in place between the blade tip and the platform;

the spar and the attachment being a separate piece; and,

Means to secure the spar to the attachment so that the shell is held in place between the blade tip and the platform;

the attachment includes an upper seal groove facing outward on the upper portion; and, the platform includes a lower seal groove facing inward on the lower portion.

20. The turbine blade of claim 19, and further comprising:

the two seal grooves included slanted upper surfaces such that a seal will be forced upward and against the opposing surface to form a tight fitting seal during rotation of the blade.

* * * * *